United States Patent [19]

Einem

[11] 4,391,541

[45] Jul. 5, 1983

[54] MOSAIC PRINTER AND RIBBON GUIDE THEREFOR

[75] Inventor: Robert E. Einem, Glendale, Calif.

[73] Assignee: International Telephone & Telegraph Corp., New York, N.Y.

[21] Appl. No.: 323,677

[22] Filed: Nov. 23, 1981

[51] Int. Cl.[3] ..... B41J 35/06

[52] U.S. Cl. ..... 400/248; 400/124

[58] Field of Search ..... 400/124, 248, 248.1; 101/93.05, 336

[56] References Cited

U.S. PATENT DOCUMENTS 1,417,909 5/1922 Hess et al. ..... 400/248

4,110,050 8/1978 Wood et al. ..... 400/248

*Primary Examiner*—Paul T. Sewell

*Attorney, Agent, or Firm*—T. E. Kristofferson; A. D. Stolzy

[57] ABSTRACT

A plastic ribbon guide to fit on a print head of a mosaic printer. The printer is a ticket printer which holds the ribbon in a stable position adjacent the tray which also acts as an anvil. The ribbon is kept taut. The ribbon guide has a shape to hold the ribbon in a positive manner.

4 Claims, 8 Drawing Figures

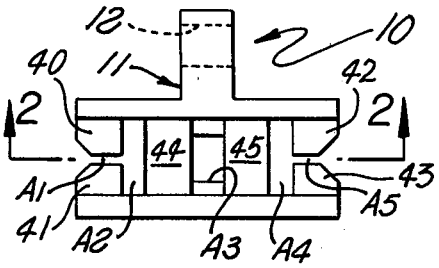
FIG. 1
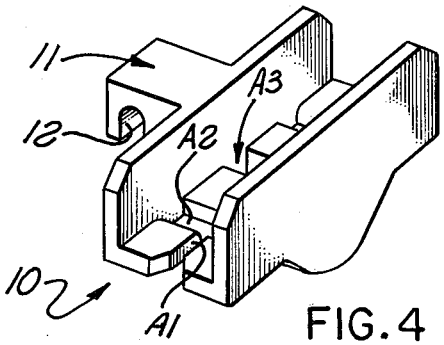
FIG. 4
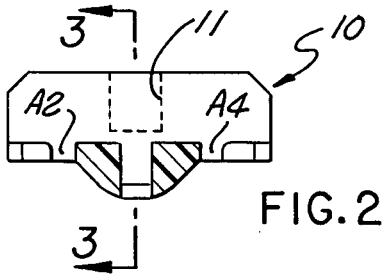
FIG. 2
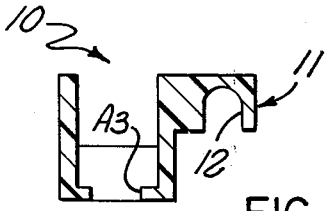
FIG. 3
FIG. 6
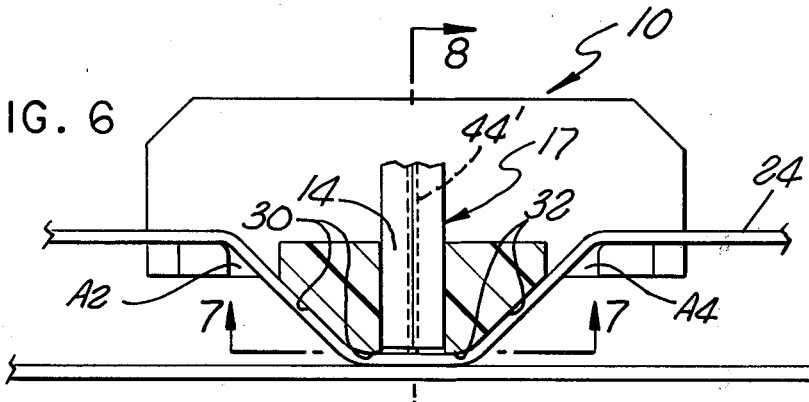
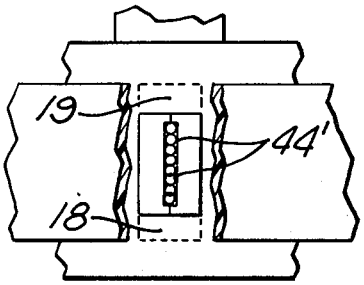
FIG. 7
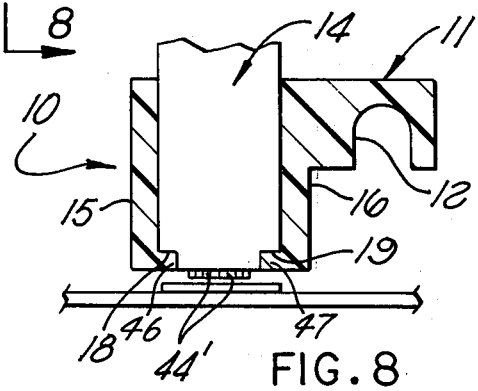
FIG. 8

MOSAIC PRINTER AND RIBBON GUIDE THEREFOR

BACKGROUND OF THE INVENTION

This invention relates generally to printers and, more particularly, to a ribbon guide for a mosaic printer or the like.

PRIOR ART STATEMENT

In the prior art, much effort has been expended in a continuing search to produce reliable and low cost ribbon guides for mosaic or dot-matrix printing heads.

The printer of the present invention is somewhat related to the following U.S. patents:

| U.S. Pat. Nos. | Issue Dates |
|---|---|
| 3,757,346 | September 4, 1973 |
| 3,830,976 | August 20, 1974 |
| 3,893,220 | July 8, 1975 |
| 3,897,865 | August 5, 1975 |
| 3,907,092 | September 23, 1975 |
| 4,158,909 | June 26, 1979 |
| 4,165,188 | August 21, 1979 |

SUMMARY OF THE INVENTION

In accordance with the ribbon guide of the present invention, the above-described and other disadvantages of the prior art are overcome by providing a ribbon guide to mount on a head of a mosaic printer and to hold an inked ribbon in a stable position and in smooth, firm contact with the print head and removably locked to slide relative to the guide or vice versa.

BRIEF DESCRIPTION OF THE DRAWINGS

In the accompanying drawings which illustrate exemplary embodiments of the present invention:

FIG. 1 is a top plan view of a ribbon guide constructed in accordance with the present invention;

FIG. 2 is a sectional view of the ribbon guide taken on the line 2—2 shown in FIG. 1;

FIG. 3 is a sectional view taken on the line 3—3 shown in FIG. 2;

FIG. 4 is a perspective view of the ribbon guide shown in FIGS. 1, 2 and 3;

FIG. 6 is a longitudinal sectional view, partly in elevation, of the carriage and ribbon guide assembly of FIG. 5 taken on the line 6—6 therein;

FIG. 7 is a bottom plan view of the print head shown in FIGS. 5 and 6; and

FIG. 8 is a transverse sectional view taken on the line 8—8 shown in FIG. 6.

DESCRIPTION OF THE PREFERRED EMBODIMENT

Figure 5:
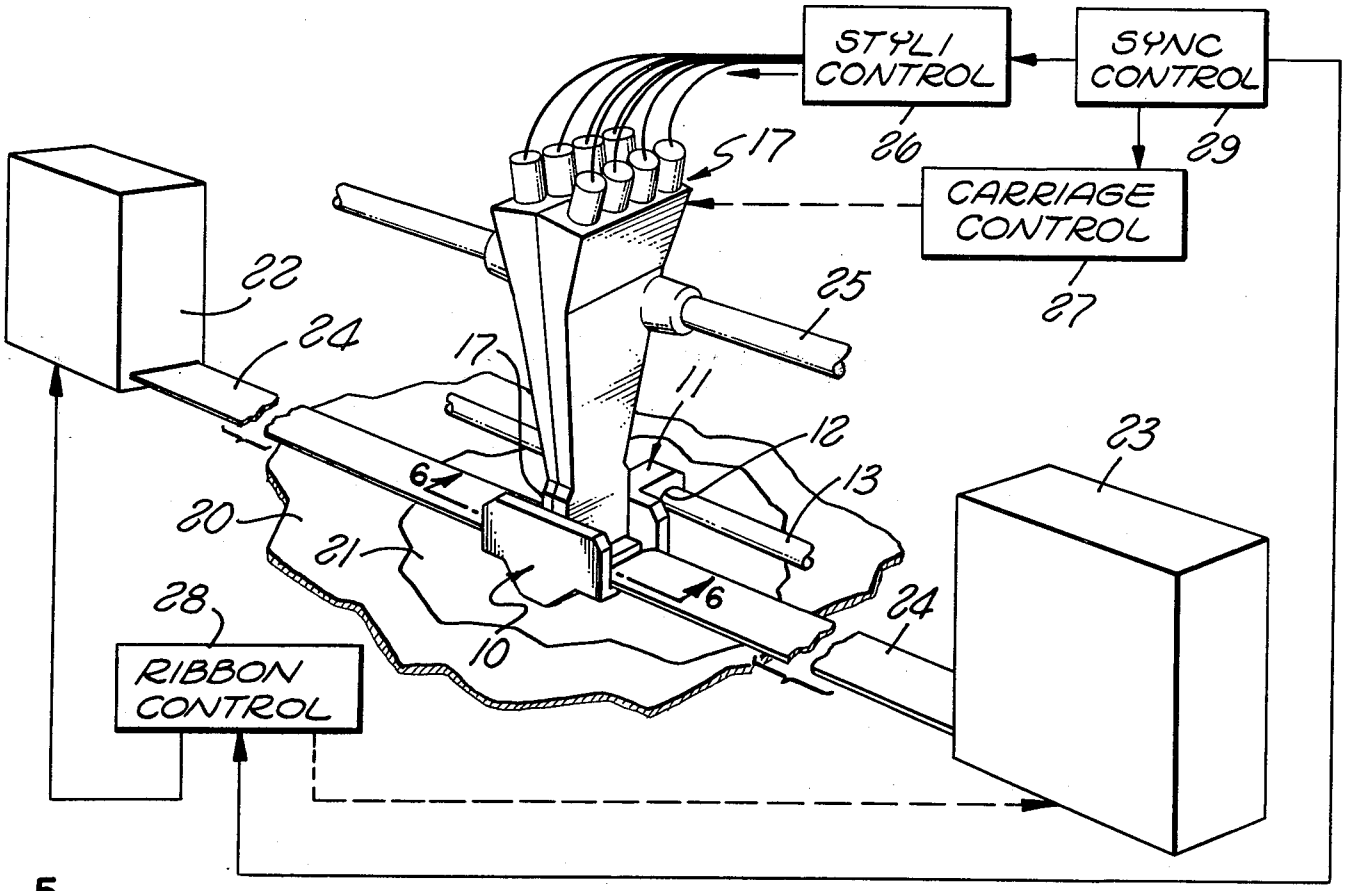
FIG. 5 is a schematic diagram of a system with which the ribbon guide of the present invention may be employed.

As shown in the drawings, in FIGS. 1-4, the ribbon guide of the present invention is shown at 10 having slots at A1, A2, A3, A4 and A5.

In FIG. 4, an appendage 11 has a groove 12 to fit over a guide rod 13. See guide rod 13 in FIG. 5.

An end 14 of a print head 17 (FIG. 6) fits between ribbon guide wings 15 and 16, and within slot A3. See FIGS. 7 and 8. Print head 17 is entirely conventional except for projections 18 and 19 in FIG. 8. Print head 17 may otherwise be identical to that disclosed in R. E. Einem et al. U.S. Pat. No. 4,158,909.

In FIG. 5, the arrangement shown is a ticket printer having a support 20 on which a "ticket" (paper) 21 is positioned. Ribbon spools (not shown) may be contained in housings 22 and 23 to transport an inked ribbon 24. Print head 17 is bonded to ribbon guide 10. Print head 17 and ribbon guide 10 are both guided on rods 25 and 13. Styli, carriage and ribbon controls 26, 27 and 28, respectively, control conventional print head solenoids, the position of the carriage or print head 17, and the position of ribbon 24.

The system of FIG. 5 may be entirely conventional except for ribbon guide 10. The same is true of a synchronizing control 29.

Ticket 21 may be a piece of paper $8\frac{1}{2}\times 11$ inches, if desired. Commonly, the same is provided with several affixed carbons.

FIG. 6 is similar to FIG. 2 with print head 17 inserted into slot A3 of ribbon guide 10.

Styli 44' in FIGS. 6 and 7 may be identical to those disclosed in the said Einem patent. Ribbon 24 goes around the lower end of the print head 17. The bottom plan view of the head 17 is shown in FIG. 7.

One advantage is that the ribbon guide 10 and print head 17 are guided and hold ribbon 24 tautly against the surfaces 30 and 32 a few thousands off of the "ticket". Ribbon 24 is snugly threaded through and snugly fitted against the surfaces of the ribbon guide 10.

Another advantage is the central location of the slots A1 and A5 through which the ribbon may be threaded. The ribbon would come unthreaded if slots A1 and A5 were not centrally located.

The utility of the present invention may be easily understood from the said Einem patent.

Print head 17 carries nine styli 44'. Print head 17 and ribbon guide 10 are slidable on guide rods 13 and 25 by carriage control 27. Print head 17 may move much faster than ribbon 24. Thus, ribbon guide 10 moves lengthwise relative to ribbon 24 while ribbon 24 is threaded therethrough as shown in FIG. 6.

Styli 44' may print any letter of the alphabet on successive impacts of each set. Styli 44' may print other characters as well. Ribbon guide 10 carries ribbon 24 as shown in FIG. 6. See also said Einem patent.

In FIGS. 7 and 8, note projections 18 and 19.

Ribbon spools within housings 22 and 23 may have sufficient conventional drag to prevent the drag of ribbon guide 10 on ribbon 24 from moving the ribbon 24.

First projections 40 and 41 shown in FIG. 1 are fixed to or integral with respective parallel wings 16 and 15. Second projections 42 and 43 are fixed to or integral with respective parallel wings 16 and 15. Projections 40 and 41 have a longitudinal slot A1 therebetween. Projections 42 and 43 have a longitudinal slot A5 therebetween. First and second members 44 and 45, respectively are fixed to and/or integral with wings 15 and 16, as shown in FIG. 1. Slot A3 may be described as a "first transverse slot." Slots A2 and A4 may be described as "second and third transverse slots." Surfaces 30 and 32 may be respectively described as "first and second lower surfaces inclined downwardly." Longitudinal notches 46 and 47 are provided in print head end 14 as shown in FIG. 8.

What is claimed is:

1. A printer comprising: a base having a paper support; an inked ribbon approximately parallel to said paper support; means to support each end of said inked ribbon lengthwise thereof over said paper support in a manner to permit a piece of paper to be inserted between said inked ribbon and said paper support; a print head having one end with a plurality of styli with ends in a line extending normal to the lengthwise direction of said inked ribbon thereacross and with axes normal to said inked ribbon; means to guide said one end of said print head over said inked ribbon; and a ribbon guide fixed relative to said one print head end, said ribbon guide including two parallel wings, pairs of first and second projections fixed to, at opposite ends and extending between said wings, said first pair of projections defining a central longitudinal slot for threading said inked ribbon therethrough, said second pair of projections defining another central longitudinal slot for threading said inked ribbon therethrough, first and second members extending transversely of and connecting said wings at longitudinally spaced positions defining a first transverse slot therebetween, said print head end being fixed within said first transverse slot presenting said styli ends approximately flush to the surfaces of said first and second members closest to said inked ribbon, said first and second pairs of projections being respectively spaced longitudinally from said first and second members and defining respective second and third transverse slots on opposite sides of said first transverse slot and parallel thereto, said first and second members having first and second lower surfaces inclined downwardly toward said one print head end within said first slot, said inked ribbon extending over said first pair of projections, downwardly through said second transverse slot, flush to and over said first inclined surface, said print head end, said second inclined surface, upwardly through said third transverse slot and over the top of said second pair of projections.

2. A printer as claimed in claim 1, wherein means are provided to move said inked ribbon, said print head and said styli synchronously.

3. A printer as claimed in claim 2, wherein said end of said print head has longitudinal notches, said wings having further projections fitting in said notches.

4. A printer as claimed in claim 1, wherein said end of said print head has longitudinal notches, said wings having further projections fitting in said notches.

* * * * *